US005450047A

United States Patent [19]

Jory

[11] Patent Number: 5,450,047

[45] Date of Patent: Sep. 12, 1995

[54] HIGH POWER WAVEGUIDE WINDOW AND WAVEGUIDE ASSEMBLY

[75] Inventor: Howard R. Jory, Menlo Park, Calif.

[73] Assignee: Varian Associates, Inc., Palo Alto, Calif.

[21] Appl. No.: 124,783

[22] Filed: Sep. 21, 1993

[51] Int. Cl.[6] ..... H01B 1/08

[52] U.S. Cl. ..... 333/252

[58] Field of Search ..... 333/248, 252

[56] References Cited

U.S. PATENT DOCUMENTS 4,286,240 8/1981 Shively et al. ..... 333/252
5,051,715 9/1991 Agosti et al. ..... 333/252

FOREIGN PATENT DOCUMENTS 0505066 9/1992 European Pat. Off. ..... 333/252
0862436 3/1961 United Kingdom ..... 333/252

*Primary Examiner*—Robert J. Pascal
*Assistant Examiner*—Darius Gambino
*Attorney, Agent, or Firm*—Fenwick & West

[57] ABSTRACT

An improved waveguide window (10) for use in high power waveguide applications. The window (10) preferably includes a thin sheet (12) of dielectric material having a first planar face (14), a second (16) face, and a support structure (18) attached to the first face (14) to provide mechanical support for the sheet (12). The support structure (18) preferably includes a plurality of parallel conductive support bars (20), each bar having an inner portion (22) attached to the first face (14) and an outer portion (24) extending away from the sheet (12), the outer portion (24) being tapered to minimize wave reflection. At least one bar (20) also has a channel (28) bored therethrough to allow a coolant to flow through the bar (20) to remove heat generated within the dielectric sheet (12). Together, the sheet (12) and the support structure (18) form a waveguide window (10) which may be used to environmentally separate one waveguide section (32) from another (34). The waveguide window (10) preserves the particular environments of each section (32, 34) while allowing electromagnetic waves to propagate from one section (32) to the other (34).

8 Claims, 6 Drawing Sheets

HIGH POWER WAVEGUIDE WINDOW AND WAVEGUIDE ASSEMBLY

TECHNICAL FIELD

This invention relates generally to electromagnetic waveguides and, more specifically, to a high power waveguide window for use in an electromagnetic waveguide.

BACKGROUND ART

Waveguides are used on a regular basis as a means for facilitating the propagation of electromagnetic waves. Typical waveguides comprise a plurality of conductive walls which define an elongated open section through which electromagnetic waves can propagate. In normal waveguide applications, it is usually not necessary to install a window across the open section of the waveguide. However, in applications where a portion of the waveguide needs to be in a vacuum, or where a section needs to reside in a pressurized environment, a window is installed across the open section of the waveguide to preserve the vacuum or the pressurized environment, and yet allow the electromagnetic waves to propagate through the window along the longitudinal axis of the waveguide.

A typical prior art waveguide window is disclosed in U.S. Pat. No. 4,286,240, wherein the window comprises two dielectric plates 18 (FIG. 1) placed across the open section of the waveguide 10, orthogonal to the longitudinal axis 12. The plates 18 allow electromagnetic waves to propagate through but keep the two halves of the waveguide environmentally separate. The two plates 18 are placed in parallel with each other and are separated by a gap 60. Cooling liquid is pumped through gap 60 to remove from the plates 18 any heat generated by electromagnetic waves propagating through the plates 18. The window described in U.S. Pat. No. 4,286,240 performs adequately in some applications, but for very high power applications in which both the frequency and the power of the electromagnetic waves are high, this prior art window fails to provide satisfactory results.

For high power applications, a large window cross-section is required to prevent electric breakdown and to maintain power dissipation at a sufficiently low level so that heat generated in the window may be dissipated by some cooling means. As the window cross-section is increased, the thickness of the window must also be increased if the window is to withstand the mechanical forces imposed by the coolant flow and the vacuum/-pressure environments. Increasing thickness, however, causes the fraction of wave power lost in the window to increase, and this, in turn, requires that the coolant pressure and flow rate be increased to carry away the additional heat. This increased flow rate imposes greater stress on the window, thus, forcing the window to have an even greater thickness. The increased thickness again requires an increased coolant flow rate, and the higher flow rate again requires a greater window thickness. Thus, a cycle of increasing the thickness of the window is created.

The practical effect of this cycle is that the prior art window is capable of handling power levels only up to a certain power limit. For applications where electromagnetic power levels exceed this limit, the prior an window falls to function properly. Typical power limits are 500 KW at 140 GHz, and 800 KW at 110 GHz.

Besides being power limited, another drawback of the prior an window is that it is expensive to produce, especially for applications near the power limit. For some applications, the cost of the window is prohibitive.

Another prior art waveguide window is disclosed in U.S. Pat. No. 5,051,715. In a first embodiment shown in FIG. 1 of the patent, this prior art coupling-out window ccmprises a plurality of conductive cooling fins 5*a*, 5*b*, 5*c* disposed among a plurality of strip-like dielectric portions 11*a*, 11*b*, 11*c*, 11*d*. The cooling fins and strip-like portions are held to each other and to mounting 7 by vacuum-tight laminar thermal contacts. Together, the fins 5*a*–5*b*, portions 11*a*–11*d*, and mounting 7 form the coupling-out window of the device.

A major disadvantage of this prior art window is that it requires the making of a relatively large number of vacuum-tight joints. Referring to FIG. 1 of the patent, at every point where a dielectric portion 11*a*–11*d* comes into contact with either a cooling fin 5*a*–5*c* or the mounting 7, a vacuum-tight joint must be made in order to keep the two sections of waveguide environmentally separate. Vacuum-tight joints, however, are difficult and time-consuming to make, which means that the coupling-out window is relatively difficult and costly to produce. Besides, the more vacuum-tight joints that are made, the higher the probability that one of the joints is not vacuum-tight, thereby rendering the window useless.

Yet another prior art waveguide window is shown in FIG. 5 of the same U.S. Pat. No. 5,051,715. The window shown in FIG. 5 comprises a single dielectric plate 6*d* having a plurality of parallel recesses 14*d*–14*f* carved into the plate 6*d*. Metal coverings 16*a*–16*c* are put over the recesses 14*d*–14*f* to form channels through which a coolant may be flowed to remove heat from the plate 6*d*. In the alternative, metal tubes may be placed within the recesses to provide the desired cooling channels.

The disadvantage of this prior art window is that, in order to successfully carve recesses into the dielectric plate 6*d*, a relatively-thick plate needs to be used. A thick dielectric plate means that a greater portion of wave power will be lost as electromagnetic waves propagate through the window. This, in turn, causes more heat to be generated.

As discussed above, none of the prior art waveguide windows provide satisfactory results in high power applications. Because of these shortcomings in the prior art, there exists a need for an improved waveguide window which can be used in high power applications and which is easy and economical to produce.

SUMMARY OF THE INVENTION

The present invention provides a waveguide window (10) comprising a sheet (12) of dielectric material having a first planar face (14) and a second face (16). Preferably, the dielectric sheet (12) has a small thickness to minimize power loss as electromagnetic waves propagate through the window (10). Because of its thinness, the dielectric sheet (12) lacks mechanical strength; thus, a conductive support structure (18) is attached to the first face (14) of the dielectric sheet (12) to provide the necessary mechanical support. The support structure (18) preferably comprises a plurality of parallel conductive support bars (20). Each support bar has a first portion (22) attached to the first face (14) of the dielectric sheet (12), and a second portion (24) extending away from the dielectric sheet (12). Preferably, the outer portion (24) of each bar (20) is tapered to minimize wave reflection. Also, each bar (20) preferably has a channel (28) bored therethrough to allow a coolant to flow through each support bar (20). Together, the plurality of support bars (20) form a support grid (18) which provides the dielectric sheet (12) with the structural support that it needs. The support grid (18) also serves a second purpose, and that is to conduct heat away from the dielectric sheet (12) to cool the sheet (12). The addition of the coolant flow significantly enhances the ability of the grid (18) to dissipate large amounts of heat. This enhanced heat removal capability contributes substantially to the window's ability to function properly when used in high power applications.

Overall, the window (10) of the present invention is a substantial improvement over the windows of the prior art. Since the dielectric sheet (12) of the present invention is kept rather thin, the power loss due to wave propagation through the sheet (12) is kept to a minimum. As a result, less heat is generated by electromagnetic waves passing through the sheet (12), which means that higher wave power levels can be tolerated. Also, the present invention does not suffer from the cycle of increasing the thickness of the dielectric sheet as does the prior art. Therefore, the present invention is not power limited by its design. In addition, the present invention is relatively economical to produce, requiring only a thin sheet of dielectric material and a conductive support grid. Much of the cost and complexity of the prior art is eliminated. In short, the waveguide window (10) of the present invention is a cost effective window capable of operating at power levels much higher than those achievable using the prior art.

BRIEF DESCRIPTION OF THE DRAWINGS

These and other more detailed and specific features of the present invention are more fully disclosed in the following specification, reference being had to the accompanying drawings, in which.

BEST MODE FOR CARRYING OUT THE INVENTION

Figure 1B:
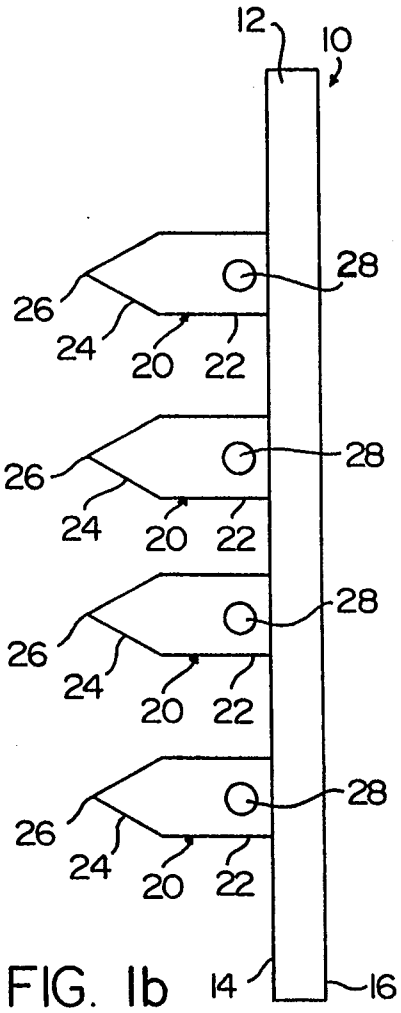
FIGS. 1*a* and 1*b* are a front plan view and a side view, respectively, of a first preferred embodiment of the window 10 of the present invention.
Figure 1A:
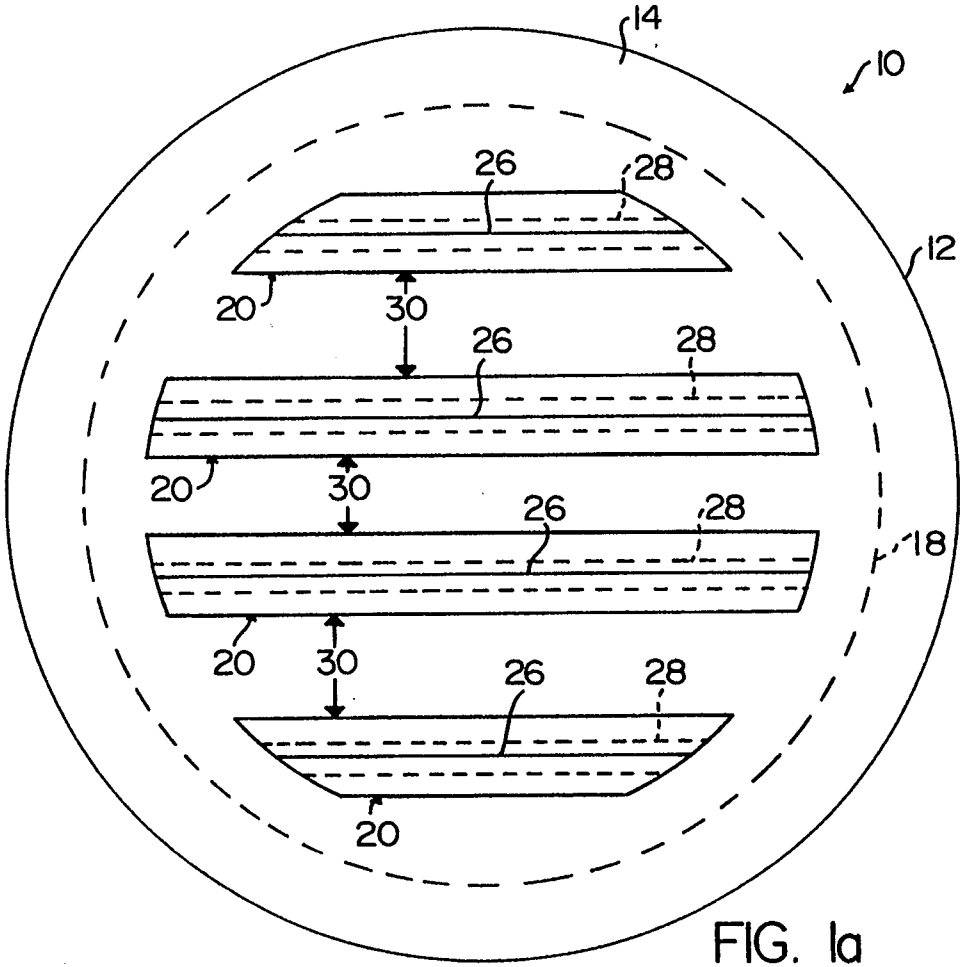

Referring to FIGS. 1*a* and 1*b*, there are shown a front plan view and a side view, respectively, of a first preferred embodiment of the waveguide window of the present invention. The window 10 comprises a flat sheet 12 of dielectric material having a first planar face 14 and a second planar face 16. The sheet 12 preferably has a small thickness (between about 0.010 and 0.050 inches) and a low dielectric constant (between about 4 and 10) to minimize power loss and hence, heat generation, as electromagnetic waves propagate through the sheet 12. Sheet 12 may be constructed of a number of different materials such as berrylia, sapphire, quartz, alumina, diamond and boron nitride, to name a few. Depending on which material is used, the thickness of the dielectric sheet 12 may vary. The choice of material is based on a trade-off analysis. The desired properties are: (1) low dielectric constant; (2) high thermal conductivity; (3) high tensile strength; and (4) low dielectric loss factor. Depending on the particular application, some of these properties may be more important than others; thus, the specific application dictates the choice of material.

Because of its thinness, sheet 12 lacks the structural strength to withstand the stress that may be exerted upon it by the vacuum and pressurized environments to which it may be exposed. To enhance the structural integrity of the window 10, a support structure 18 is attached to the first face 14 of the dielectric sheet 12. Support structure 18 preferably comprises a plurality of substantially parallel, relatively rigid support bars 20, each support bar 20 having an inner portion 22 which is attached to the first face 14 of the dielectric sheet 12, and an outer portion 24 which extends away from sheet 12. Together, the bars 20 form a support grid 18 which extends across most of the surface of sheet 12 to impart to the sheet 12 the structural support needed to prevent bending or breaking when subjected to mechanical stress. The inner portions 22 of the support bars 20 may be attached to sheet 12 by such well-known means as brazing or diffusion bonding. A low vapor pressure heat sink compound may also be used for attachment purposes. Whichever attachment means is used, structure 18 is preferably attached to sheet 12 in such a manner that a solid thermal and mechanical bond is formed. While the bond formed between structure 18 and sheet 12 may be vacuum tight, this is not required.

The support structure 18, in addition to providing structural support for sheet 12, also serves the purpose of dissipating heat generated within sheet 12 when electromagnetic waves propagate therethrough. To properly serve this purpose, the bars 20 are preferably constructed of a material having high thermal conductivity. Materials such as copper composite and niobium, for example, may be used. The high thermal conductivity, coupled with the solid thermal bond formed between structure 18 and sheet 12, allows the bars 20 to readily carry heat away from the dielectric sheet 12. In addition to high thermal conductivity, it is also desirable in many applications for the support bars 20 to have high surface electrical conductivity. To impart such a property to the support bars 20, the bars 20 may be plated with an electrical conductor such as copper. Futhermore, it is preferable that the bars 20 have approximately the same thermal expansion coefficient as the dielectric sheet 12, so that when the bars 20 and sheet 12 are subjected to heat, they expand and contract at the same rate. This prevents shearing stress from occurring between the sheet 12 and the bars 20, which in turn, prevents tearing of the bond formed between the bars 20 and sheet 12.

Figure 1C:
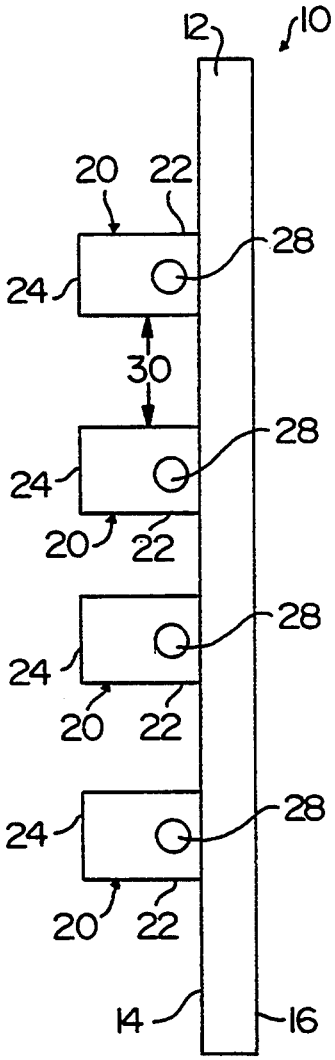
FIG. 1*c* is a side view of an alternate embodiment of the window 10 of the present invention wherein the outer portions 24 of the bars 20 are not tapered.

As shown in FIG. 1*a*, the support bars 20 cover a significant portion of the surface of sheet 12. Since the bars 20 are made of a conductive material, they have a tendency to reflect some of the electromagnetic waves propagating through the dielectric sheet 12. To minimize wave reflection, the outer portions 24 of the bars 20 are preferably tapered to form a relatively sharp edge 26 as shown in FIG. 1*b*. It has been found that, taping the support bars 20 in this manner eliminates wave reflection at some frequencies and produces very little wave reflection over some bandwidth. The specific bandwidth is dependent upon the bar dimensions, the dielectric constant, and the thickness of the dielectric sheet and, thus, is application specific. Alternatively, the support bars 20 may be left untapered as shown in FIG. 1*c*. In such a configuration, wave reflection is minimized by discriminately selecting the dimensions of the bars 20 and the distance 30 separating the bars 20. The selection of the dimensions and the distance 30 are dependent upon various factors including the frequency of the propagating electromagnetic wave and the desired bandwidth. The selection of the bar dimensions and the distance 30 are thus application specific.

As mentioned briefly above, the support grid 18 not only provides support, but also acts as a cooling mechanism by carrying heat away from the sheet 12. To enhance the cooling characteristics of the grid 18, at least one of the bars 20, and preferably each of the bars 20, has a channel 28 bored therethrough to allow a coolant such as water or fluorocarbon gas or liquid to be flowed through the bar 20. The addition of the coolant flow removes significantly more heat than just the grid alone, and this enhanced heat removal capability is needed in high power applications where large amounts of heat are generated within the dielectric sheet 12. To provide sufficient room for a cooling channel to be bored therethrough, each of the bars 20 preferably has a thickness on the order of half the spacing 30 between the bars 30. To take full advantage of the grid's cooling capability, the spacing 30 between the bars 20 is preferably kept small enough so that heat generated between the bars 20 can adequately conduct to the bars 20 to allow the bars to dissipate the heat. This spacing 30 is preferably on the order of, or less than, a free space wavelength where a free space wavelength is defined as $\lambda=c/f$, where c is the speed of light and f is the frequency of the electromagnetic wave propagating through the window 10.

Figure 2:
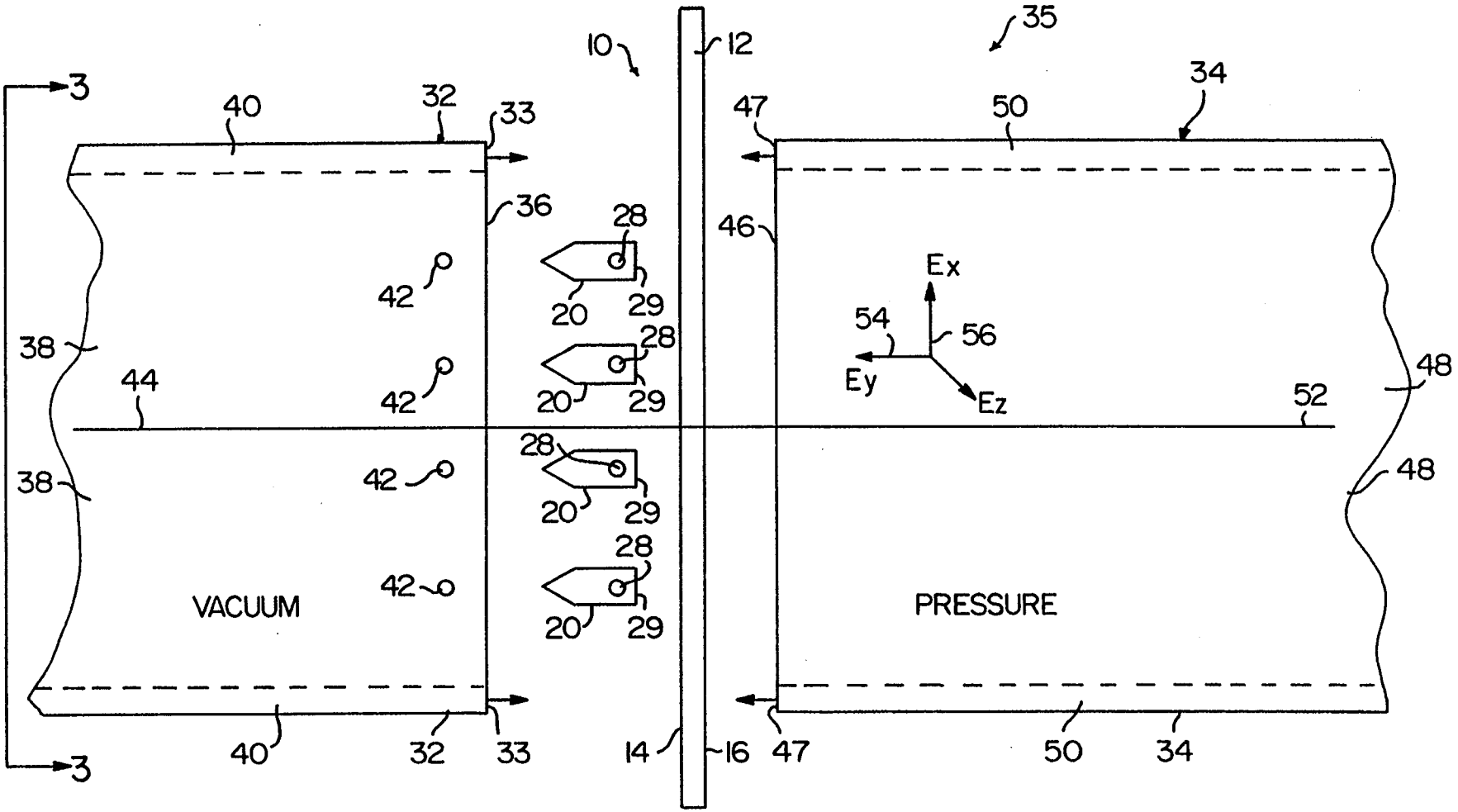
FIG. 2 is a side view of a first waveguide section 32, a window 10 of the present invention, and a second waveguide section 34 illustrating the incorporation of the window into a waveguide assembly 35.
Figure 3:
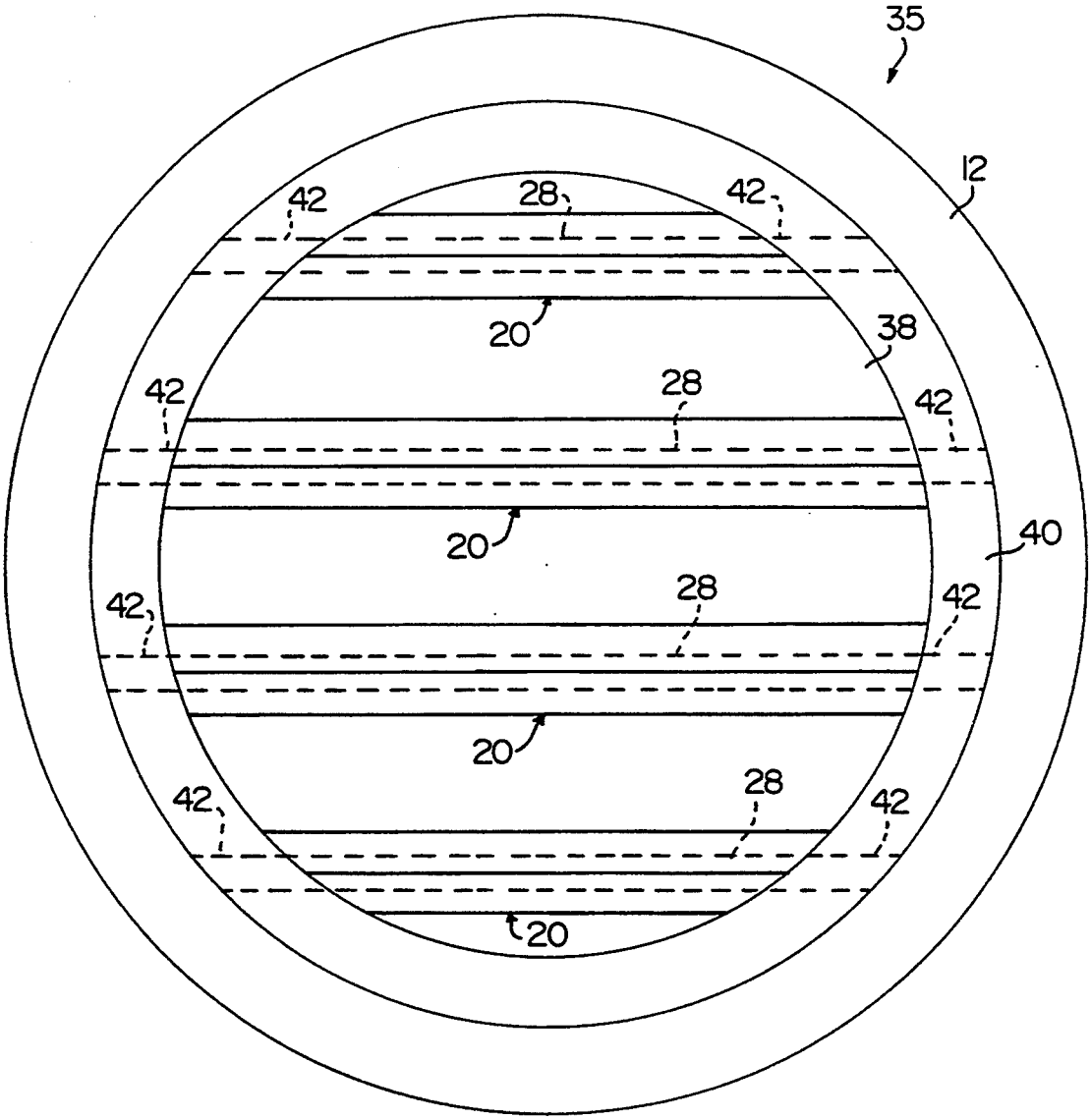
FIG. 3 is a view of the hollow cross-section of waveguide section 32 taken along view line 3—3 of FIG. 2.

With reference to FIG. 2, there is shown a side view of a first waveguide section 32, a window 10 of the present invention, and a second waveguide section 34, to illustrate the incorporation of window 10 into a waveguide assembly 35. The first waveguide section 32 preferably takes the form of a cylindrical waveguide having a first open end 36, a hollow inner portion 38, waveguide walls 40, and a plurality of channels 42 bored through walls 40. Window 10 is incorporated into assembly 35 by first placing the open end 36 of waveguide 32 around the support bars 20 such that: (1) the channels 42 in waveguide 32 are aligned with the coolant channels 28 in the support bars 20; and (2) the flat ends 29 of support bars 20 are substantially flush with the plane of the open end 36 of waveguide 32. Once properly positioned relative to each other, the bars 20 are attached to the walls 40 of the waveguide 32 preferably by means of brazing. This is better illustrated in FIG. 3, wherein a view is provided of the open section of waveguide 32 taken along view line 3—3 of FIG. 2. As shown in FIG. 3, the walls 40 of waveguide 32 completely surround the support bars 20, and the ends of the support bars 20 contact and are attached to the walls 40. With the support bars 20 attached in such a manner, a coolant (not shown) may be flowed from one side of the waveguide 32 to the other side via the coolant channels 28 in the bars 20 and the coolant channels 42 in the walls 40 of the waveguide 32. To flow a coolant through the support bars 20, a manifold (not shown) may be coupled to the channels 42 in waveguide section 32 to pump a coolant into and out of the cooling channels 28 in the support bars 20. Such a manifold is well known in the art. In FIG. 3, channels 28 are shown to be straight, but it should be noted that these channels 28 may take on other shapes. In some applications, different-shaped channels may enhance wave transfer through the window 10 and these other shapes are within the scope of the present invention.

After supports bars 20 are attached to waveguide 32, the flat ends 29 (FIG. 2) of bars 20 and the open end 36 of waveguide 32 are machined to form a flat surface for accommodating the first face 14 of dielectric sheet 12. Once this is done, the first face 14 of dielectric sheet 12 is attached to the flat ends 29 of the support bars 20 and to the edge 33 of waveguide 32. Sheet 12 may be attached to bars 20 by using such means as diffusion bonding, brazing, or bonding using a low vapor pressure heat sink compound, and sheet 12 may be attached to the edge 33 of waveguide 32 by using a face or an edge braze. Such attachment techniques are well-known in the art. An air-tight connection is thus formed between the waveguide 32 and the dielectric sheet 12. After attachment, sheet 12 preferably covers the entire open end 36 of waveguide section 32, and sits orthogonally with respect to the longitudinal axis 44 of the waveguide 32.

After waveguide 32 is attached to sheet 12, the second waveguide 34 is placed against the second face 16 of the dielectric sheet 12. Waveguide 34 preferably is also a cylindrical waveguide having an open end 46, a hollow portion 48, and walls 50. Waveguide 34 preferably has the same diameter as waveguide 32 so that, when open end 46 is placed against the dielectric sheet 12, the walls 50 of waveguide 34 are aligned with the walls 40 of waveguide 32, and the longitudinal axis 52 of waveguide 34 is aligned with axis 44 of waveguide 32. After waveguide 34 is properly positioned against sheet 12, the edge 47 of the waveguide 34 is preferably attached to the second face 16 of the dielectric sheet 12 using a face or an edge braze to form an air-tight connection between sheet 12 and waveguide 34. As an alternative to using a face or an edge braze, the second waveguide 34 may be attached to the assembly 35 by means of a metallic joint (not shown) which extends from the first waveguide 32, around the periphery of the dielectric sheet 12, to the second waveguide 34. Such a metallic joint also serves to form a vacuum tight connection between the second waveguide 34 and the sheet 12. Thus far, techniques have been described for forming a vacuum tight connection between waveguide 34 and sheet 12, but it should be noted that, in some applications, a vacuum tight connection between sheet 12 and waveguide 34 is not necessary. In such applications, waveguide 34 may be attached to assembly 35 using non-vacuum tight means. After waveguide 34 is properly attached to the assembly 35, window 10 completely covers the open ends 36, 46 of both of the waveguides 32, 34 to environmentally isolate each waveguide section 32, 34 from the other. Window 10 is thus incorporated into the waveguide assembly 35.

In operation, waveguide assembly 35 may be used to propagate electromagnetic waves from one medium to another. For example, the hollow portion 38 of waveguide 32 may be evacuated while the hollow portion 48 of waveguide 34 may be pressurized. Due to the presence of the window 10, each waveguide section 32, 34 is environmentally sealed from the other. Thus, the evacuated and pressurized environments are preserved, yet electromagnetic waves are allowed to propagate through window 10 to travel from one waveguide section 32, 34 to another.

One limitation of the window 10 thus far described is that it does not allow electromagnetic waves having an E field 54 parallel to the support bars 20 to optimally propagate therethrough. Waves polarized in such a direction are significantly reflected by the conductive bars 20. The waveguide assembly 35 shown in FIG. 2 is best suited for propagating electromagnetic waves having an E field only in the transverse direction 56, perpendicular to the conductive support bars 20. Gaussian TEM and HE are two modes which fit this definition; thus, these modes can effectively propagate through assembly 35.

Figure 4:
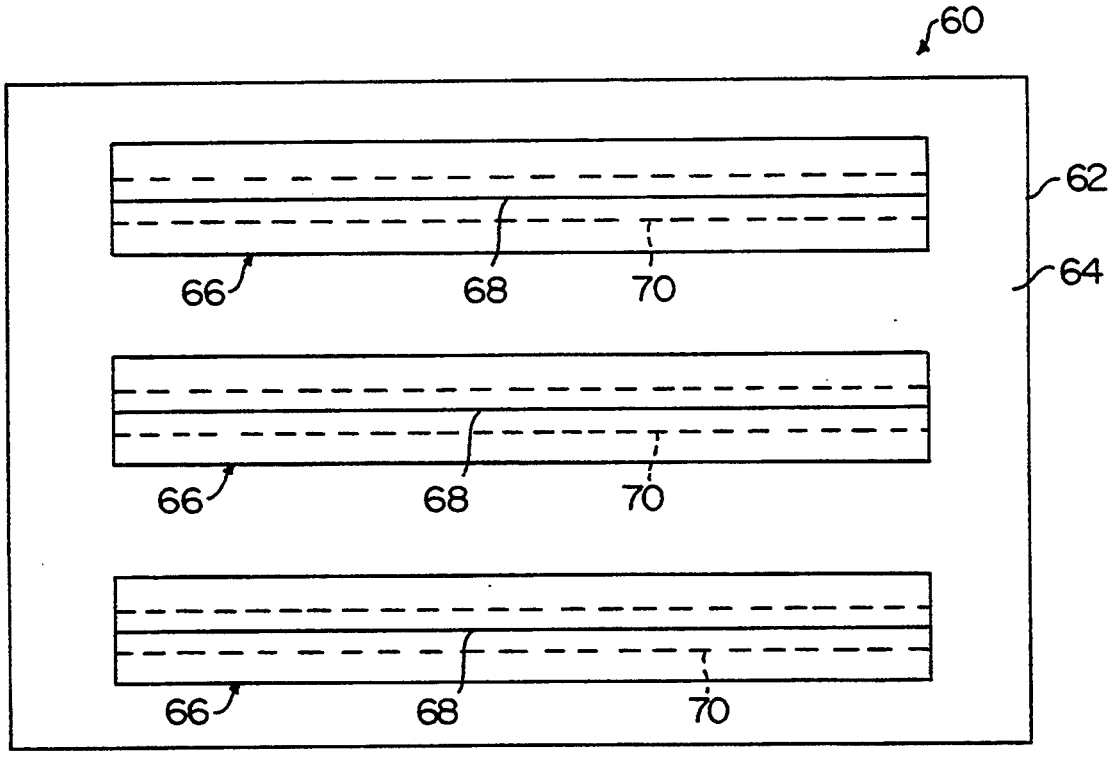
FIG. 4 is a front plan view of an alternate embodiment of the present invention, wherein the window 60 has a rectangular cross-section.

An alternative preferred embodiment of the present invention is shown in FIG. 4, wherein the window 60 takes a rectangular rather than a circular form. Window 60 is designed to be used in a rectangular waveguide. Like the embodiment previously described, window 60 comprises a thin dielectric sheet 62 having a first planar face 64, and a plurality of substantially parallel conductive support bars 66 attached to the first face 64. Each bar 66 has an outer portion which is tapered to form an edge 68. In addition, a coolant channel 70 is bored through each of the bars 66 to allow a coolant to flow therethrough. Window 60 is identical to window 10 in all respects except that window 60 has a rectangular cross-section rather than a circular one. Since the support bars 66 in window 60 are situated very much like the bars in window 10, window 60 reflects linearly polarized signals as did window 10. Thus, window 60 is also best suited for propagating electromagnetic waves having an E field only in a direction perpendicular to the conductive support bars 66.

Window 66 may be incorporated into a waveguide assembly in much the same manner as that described above in connection with window 10. As with window 10, the support bars 66 are first attached to the walls of a rectangular waveguide, and thereafter, the first face 64 of dielectric sheet 62 is attached to both the support bars 66 and the edge of the waveguide. A second rectangular waveguide is then attached to the opposite face of the dielectric sheet 62 to complete the assembly.

Figure 5:
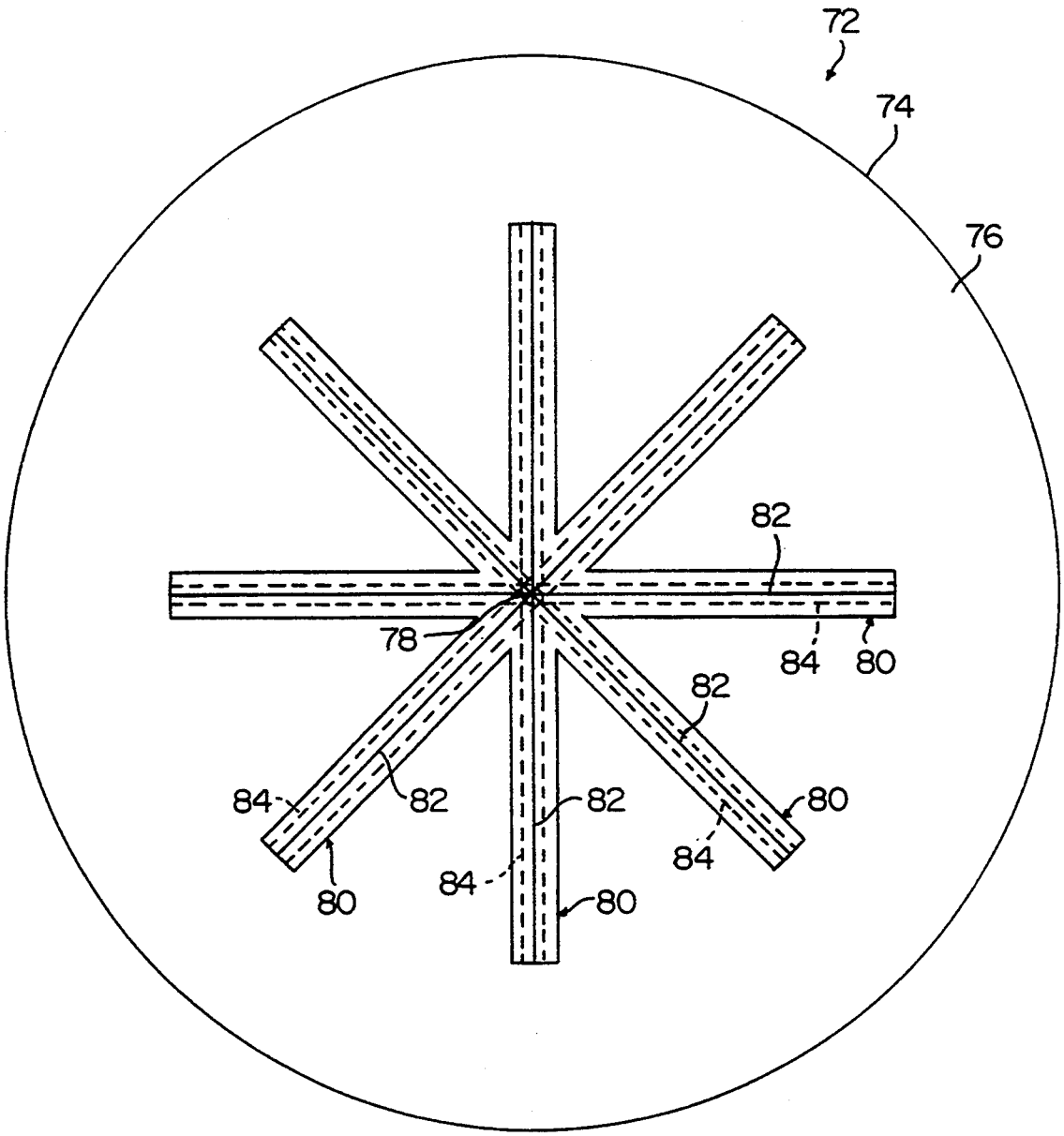
FIG. 5 is a front plan view of another alternate embodiment of the present invention, wherein the window 72 has a plurality of support bars 80 extending radially from the center 78 of a dielectric sheet 74.

FIG. 5 shows yet another alternate embodiment of the present invention. As illustrated in FIG. 5, window 72 comprises a thin round dielectric sheet 74 having a first planar face 76 and a center 78. Passing through the center 78 are a plurality of conductive support bars 80. Bars 80 are very similar to the bars 20 in FIGS. 1*a* and 1*b* in that each bar 80 comprises an inner portion which is attached to the face 76 of sheet 74, and an outer portion extending away from sheet 74. The outer portions of bars 80 are tapered to form an edge 82, and a coolant channel 84 is bored through at least one and preferably each of the bars 80 to allow a coolant to flow therethrough. Window 72 is designed to accommodate electromagnetic waves with circular E field lines. Because bars 80 extend radially from the center 78 of sheet 74, the bars 80 are perpendicular to the circular E field lines of waveguide modes of the class $TE_{0,n}$. As was the case with the parallel support bars 20 (FIG. 1*a*), electromagnetic waves having E field lines perpendicular to the conductive bars 82 are left substantially unreflected. Two electromagnetic wave modes which have circular E field lines are the $TE_{01}$ and the $TE_{02}$ modes; thus, these two modes may efficiently propagate through window 72.

Window 72 is incorporated into a waveguide assembly in substantially the same manner as that described above for the other preferred embodiments. Namely, the ends of support bars 80 are first attached to the walls of a first cylindrical waveguide and, thereafter, the first face 76 of dielectric sheet 74 is attached to both the support bars 80 and the edge of the first waveguide. The assembly is completed by attaching a second cylindrical waveguide to the opposite face of the dielectric sheet. The same techniques and considerations used in connection with incorporation of window 10 into assembly 35 also apply here.

It should be noted that, while the invention has been described with reference to specific embodiments, the invention should not be construed to be so limited. Various modifications may be made by those of ordinary skill in the art with the benefit of this disclosure without departing from the spirit of the invention. For example, the invention has been described as having a support structure on only one face of a dielectric sheet, but it is possible to attach support structures on both sides of the dielectric sheet. This and other modifications are within the spirit and scope of the invention. Therefore, the invention should not be limited by the examples used to illustrate it but only by the scope of the appended claims.

What is claimed is:

1. A window for placement across an open section of a waveguide, comprising:

a sheet of dielectric material having a first planar face; and a conductive support structure attached to said first face for providing mechanical support for said sheet of dielectric material, said support structure comprising a plurality of conductive support bars, each support bar having a first portion attached to said first face, and a second portion extending away from said first face, each support bar passing through a selected central point.

2. The window of claim 1, wherein the second portion of at least one of said support bars is tapered to form an edge extending away from said first face.

3. The window of claim 1, wherein at least one of said support bars comprises an inner channel.

4. The window of claim 1, wherein said support structure forms a thermal and a mechanical bond with said planar face to provide mechanical support for, and to conduct heat away from, said sheet of dielectric material.

5. A waveguide assembly, comprising:

a dielectric sheet having a first planar face and a second face;

a conductive support structure attached to said first face for providing support for said dielectric sheet, said support structure comprising a plurality of conductive support bars, each support bar having a first portion attached to said first face, and a second portion extending away from said first face, each support bar passing through a selected central point;

a first waveguide section having a first open end placed around said support structure and against the first face of said dielectric sheet to allow said window to cover said first open end; and a second waveguide section having a second open end placed against the second face of said dielectric sheet to allow said window to cover said second open end.

6. The waveguide assembly of claim 5, wherein the second portion of at least one of said support bars is tapered to form an edge extending away from said first face.

7. The waveguide assembly of claim 5, wherein at least one of said support bars has an inner channel bored therethrough.

8. The assembly of claim 5, wherein said support structure forms a thermal and a mechanical bond with said planar face to provide mechanical support for, and to conduct heat away from, said dielectric sheet.

* * * * *